United States Patent [19]

Norton et al.

[11] Patent Number: 4,603,662

[45] Date of Patent: Aug. 5, 1986

[54] FUELS

[75] Inventors: John H. R. Norton, Johannesburg; Peter R. Rebello, Hurleyvale, both of South Africa

[73] Assignee: AECI Limited, Johannesburg, South Africa

[21] Appl. No.: 146,367

[22] Filed: May 2, 1980

[30] Foreign Application Priority Data

May 14, 1979 [ZA] South Africa ..... 79/2323

[51] Int. Cl.[4] ..... F02B 75/12; C10L 1/02

[52] U.S. Cl. ..... 123/1 A; 123/575; 123/180 R; 44/56

[58] Field of Search ..... 44/56, 53, 57, 58; 123/575, 1 A, 180 R

[56] References Cited

U.S. PATENT DOCUMENTS

| | | | |
|---|---|---|---|
| 1,338,982 | 5/1920 | Hayes . | |
| 1,338,983 | 5/1920 | Hayes | 44/53 |
| 1,377,992 | 5/1921 | Lepetit . | |
| 1,384,946 | 7/1921 | Foster . | |
| 1,398,947 | 11/1921 | Schreiber . | |
| 1,420,622 | 6/1922 | Charbonneaux | 44/53 |
| 1,469,053 | 9/1923 | Schreiber . | |
| 1,471,566 | 10/1923 | Murphy . | |
| 1,495,094 | 5/1924 | Morgan | 44/53 |
| 1,496,260 | 6/1924 | Ferrer . | |
| 1,527,144 | 2/1925 | Lichtenthaeler | 44/53 |
| 1,572,750 | 2/1926 | Morgan | 44/53 |
| 1,684,685 | 9/1928 | Records . | |
| 1,775,461 | 9/1930 | Menefee . | |
| 1,960,633 | 5/1934 | Joshua et al. | 44/53 |
| 3,650,255 | 3/1972 | McJones | 123/575 |
| 3,960,131 | 11/1974 | Davis | 123/180 R |
| 4,123,997 | 11/1978 | Oswald et al. | 123/1 A |
| 4,216,744 | 8/1980 | Oswald et al. | 123/1 A |

FOREIGN PATENT DOCUMENTS

| | | |
|---|---|---|
| 544947 | 2/1956 | Belgium . |
| 654470 | 12/1937 | Fed. Rep. of Germany . |
| 2419439 | 11/1975 | Fed. Rep. of Germany . |
| 476494 | 8/1915 | France . |
| 492239 | 7/1919 | France . |
| 499657 | 2/1920 | France . |
| 499656 | 2/1920 | France . |
| 511487 | 12/1920 | France . |
| 529658 | 12/1921 | France . |
| 538322 | 6/1922 | France . |
| 556184 | 7/1923 | France . |
| 26669 | 2/1924 | France . |
| 579625 | 10/1924 | France . |
| 575653 | 5/1925 | France . |
| 868126 | 12/1941 | France . |
| 867885 | 12/1941 | France . |
| 868537 | 1/1942 | France . |
| 869828 | 2/1942 | France . |
| 56535 | 9/1952 | France . |
| 2243991 | 4/1975 | France . |
| 2329739 | 5/1977 | France . |
| 387421 | 7/1941 | Italy . |
| 90302 | 8/1921 | Switzerland . |
| 95459 | 7/1922 | Switzerland . |
| 232610 | 9/1944 | Switzerland . |
| 21316 | of 1915 | United Kingdom . |
| 187051 | 10/1922 | United Kingdom . |

OTHER PUBLICATIONS

"Man-m-Vielstoffmotor Mit Parteiler Abgasruckfuhurng Fur Alkoholbetrief", by Erhard Muhlberg in Automobiltechnische Zeitrung, No. 1, Jan. 1963, vol. 65, pp. 16 to 24 (1).

"Automobiltechnisches Handbook", edition 18, Berlin, 1965, p. 1014.

*Primary Examiner*—Ira S. Lazarus

*Attorney, Agent, or Firm*—Cushman, Darby & Cushman

[57] ABSTRACT

The invention concerns a fuel comprising a mixture of at least one alcohol and at least one ether. The ether conveniently has a boiling point below 200° C., preferably below 100° C. The fuel can comprise lower aliphatic alcohols and ethers. An engine may be run on the fuel by injecting the constituents separately or as a mixture. The fuel may optionally contain diesel fuel and/or castor oil.

2 Claims, No Drawings

FUELS

This invention relates to fuels, in particular to fuels for compression ignition engines.

The use of alcohols, particularly methanol and ethanol, as a fuel suffers from the drawback that, so far as we are aware, they cannot be used in compression ignition engines, commonly known as diesel engines except when mixed with diesel or expensive cetane improvers such as amyl nitrate and isopropyl nitrate. On the other hand, it would be desirable to utilise alcohols as a fuel since they are obtainable from raw materials other than petroleum, such as coal and various carbohydrates, of which there are large resources in many Western countries, and particularly in the Republic of South Africa.

The present invention provides a fuel comprising a mixture of at least one alcohol and at least one ether. The ether may have a boiling point below 200° C. and may be very volatile, for example by having a boiling point below 100° C.

The invention also provides a method of running an engine, which comprises injecting into the engine at least one alcohol and at least one ether. The ether may have a boiling point below 200° C., e.g. below 100° C.

The ether conveniently may be an aliphatic ether having from 1 to about 10 carbon atoms. The ether may be a straight chain dialkyl ether in which each alkyl group contains from 1 to 5 carbon atoms, or a cyclic ether. Examples are dimethyl ether, diethyl ether, methyl ethyl ether, di-n-propyl ether, isoamyl ether and tetrahydrofuran.

The alcohol may be an aliphatic alcohol, for example one having from 1 to 10 carbon atoms. Particular examples are aliphatic alcohols having 1 to 5 carbon atoms, for example methanol, ethanol, n-propanol and n-butanol.

A particularly convenient fuel is dimethyl ether and methanol. Dimethyl ether is soluble in methanol at room temperatures and pressures.

The engine conveniently is a compression ignition engine. Both constituents may be injected together as a mixture, or they may be injected separately, for example through the inlet manifold and through the normal injectors of the engine.

Methanol and higher alcohols may be manufactured from carbonaceous feedstocks, usually petroleum or coal, but also carbohydrates such as wood, maize, sugar etc. The fuel may be manufactured by partially dehydrating a mixture of alcohols to form a mixture of alcohols and ethers.

With the fuel provided by the invention, the ratio of the constituents may vary. Generally speaking, for use in a compression ignition engine, from 5 to 80%, more usually from 5 to 20% by volume of the fuel may be ethers.

In addition to comprising alcohols and ethers, the fuel may contain other constituents. The fuel may contain normal diesel fuel. Further or alternative constituents which the fuel may contain are other solvents, including other alcohols (such as higher boiling point alcohols), other ethers (for example higher boiling point ethers), other cetane improvers, or water. The fuel may contain small amounts of lubricants, e.g. up to about 2% by volume (more generally about 1% by volume) of an oil, for example, a suitable mineral oil or vegetable oil, such as castor oil.

The invention is illustrated in non-limiting manner by reference to the following Examples. All tests on the various fuels were carried out on a 3,47 liter, 4 cylinder compression ignition (diesel) engine with a compression ratio of 15,5:1. In some instances the fuels were injected into the cylinder via the normal diesel injectors; some examples were carried out where the alcohol was injected through the diesel injectors and the ether through the inlet manifold and some of the examples were carried out with the entire fuel being injected through the inlet manifold, as will appear from the information below.

EXAMPLE 1

Dimethyl ether was passed under pressure through an injection device into the air inlet manifold and methanol was passed through the normal diesel injection jet into the cylinder. The ratio of constituents was adjusted, using a metering device to provide a mixture in the cylinder of the engine comprising about 95% by volume of methanol and 5% by volume of dimethyl ether. The engine ran smoothly on this mixture.

EXAMPLE 2

Ethanol was placed in a container and dimethyl ether was passed into the container. The dimethyl ether dissolved in the ethanol. When about 5% by volume of dimethyl ether had dissolved, the supply of dimethyl ether was closed off. The liquid fuel obtained was injected into the compression ignition engine. The engine ran smoothly on the mixture.

EXAMPLE 3

The mixture of Example 1 was used but, before being injected into the engine, about 1% by volume of castor oil was added. Once again, the compression nitrogen engine ran smoothly.

EXAMPLE 4

Following the procedure of Example 1, dimethyl ether was passed under pressure through the injection device into the air inlet manifold and ethanol was passed through the injection jet into the cylinder. The ratio of constituents was adjusted, using a metering device to provide a mixture in the cylinder of the engine comprising about 85% by volume of ethanol and 5% by volume of dimethyl ether. The engine ran smoothly on this mixture.

There was no cold-starting problem.

EXAMPLE 5

Following the procedure of Examples 1 and 4, the following fuels were tested in the engine in the same manner. In each case, the engine started and ran smoothly on the fuel. The percentages are by volume.

| Example | Air Inlet Manifold | Injectors |
|---|---|---|
| 5.1 | 20% dimethyl ether | 78% methanol, 2% castor oil |
| 5.2 | 20% diethyl ether | 78% methanol, 2% castor oil |
| 5.3 | 20% dimethyl ether | 80% ethanol |
| 5.4 | 20% diethyl ether | 80% ethanol |
| 5.5 | 20% dimethyl ether | 80% n-propanol |
| 5.6 | 20% diethyl ether | 80% n-propanol |
| 5.7 | 20% dimethyl ether | 80% n-butanol |
| 5.8 | 20% diethyl ether | 80% n-butanol |

-continued

| Example | Air Inlet Manifold | Injectors |
|---|---|---|
| 5.9 | 80% isoamyl ether | 20% methanol |

EXAMPLE 6

In the tests set out below, the following fuels were injected through the air inlet manifold or the normal diesel injectors. In each case, the engine started and ran smoothly on the fuel. The percentages are by volume.

| Example | Air Inlet Manifold | Injectors |
|---|---|---|
| 6.1 | | 30% diethyl ether, 70% methanol |
| 6.2 | 60% di n-propyl ether, 40% methanol | |
| 6.3 | | 50% di n-propyl ester, 50% ethanol |
| 6.4 | | 20% diethyl ether, 80% ethanol |
| 6.5 | 60% di n-butyl ether, 40% methanol | |
| 6.6 | | 30% tetrahydrofuran, 40% diesel, 30% methanol |

What is claimed is:

1. A method of running a compression ignition engine having a cylinder, a fuel injector into the cylinder, and an air inlet manifold leading to the cylinder, which method comprises injecting at least one alcohol into the engine through the fuel injector and at least one ether into the engine through the air inlet manifold.

2. A method as claimed in claim 1, wherein the alcohol is selected from the group consisting of methanol, ethanol, n-propanol and n-butanol, and the ether is selected from the group consisting of dimethyl ether, diethyl ether, di-n-propyl ether, methyl ethyl ether, isoamyl ether and tetrahydrofuran.

* * * * *